US006210218B1

(12) United States Patent
Chang

(10) Patent No.: US 6,210,218 B1
(45) Date of Patent: Apr. 3, 2001

(54) ELECTRICAL CONNECTOR

(75) Inventor: Yao-Hao Chang, Chung-Ho (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/447,937

(22) Filed: Nov. 23, 1999

(30) Foreign Application Priority Data

Aug. 10, 1999 (TW) ..... 88213502

(51) Int. Cl.[7] ..... H01R 13/648
(52) U.S. Cl. ..... 439/567; 439/79
(58) Field of Search ..... 439/567, 571, 439/572, 79, 607, 609

(56) References Cited

U.S. PATENT DOCUMENTS 5,356,313 * 10/1994 Niwa et al. ..... 439/567
5,599,207 * 2/1997 Lai ..... 439/567
5,738,541 * 4/1998 Tseng ..... 439/567
5,921,811 * 7/1999 Hsu ..... 439/567
6,012,954 * 1/2000 Wu ..... 439/567
6,022,243 * 2/2000 Yang et al. ..... 439/567

* cited by examiner

*Primary Examiner*—Gary F. Paumen
(74) *Attorney, Agent, or Firm*—Wei Te Chung

(57) ABSTRACT

An electrical connector of the present invention is provided for mating with a complementary connector and comprises a dielectric housing, a conductive shield covering a front end of the housing, a contact module assembly received in a rear end of the housing, a spacer and a pair of grounding elements. The contact module assembly has a plurality of projections on lateral ends thereof and a plurality of barbs located on the projections for engaging with a plurality of channels defined in the rear end of the housing. The spacer attaches at the rear end of the housing, providing support to the contact terminals of the contact module assembly. Each of the grounding elements includes a flat joining part, a board lock bent downward from a lateral edge of the joining part for fixing in a PCB and a grounding finger approximately horizontally extending from the edge of the joining part. A pair of top and bottom extending arms depends from top and bottom edges of the shield to attach the shield to the housing. The shield and the grounding elements are therefore mechanically and electrically connected for grounding to the PCB.

1 Claim, 7 Drawing Sheets

ELECTRICAL CONNECTOR

BACKGROUND OF THE INVENTION

1. Field of the Invention

The present invention relates to a connector, and particularly to a connector which can be more readily assembled and has EMI shielding with a simple and reliable grounding connection.

2. Description of the Prior Art

Prior art connectors generally have means to provide EMI shielding, but such means may be complex or may not be reliable. U.S. Pat. No. 4,943,244 discloses a connector having a housing with base, a shield from which a pair of grounding fingers rearwardly extends and a pair of board locks each comprising a flat clamp at one end thereof and a pair of L-shaped feet at the other end thereof. The clamp and the feet define a channel therebetween. In assembly, the board lock is pressed to sandwich the base and a rear end of the grounding finger in the channel of the board lock. Since the housing and the shield will forwardly move during an unmating of a complementary connector, the grounding fingers may disengage from the board locks after a number of mating/unmating of the connector with/from the complementary connector.

Furthermore, for the '244 connector, it is laborious and troublesome to assemble contacts to the housing thereof.

Hence, an improved electrical connector is required to overcome the disadvantages of the prior art.

BRIEF SUMMARY OF THE INVENTION

A first object of the present invention is to provide an electrical connector providing effective EMI shielding;

A second object of the present invention is to provide an electrical connector having a pair of grounding elements reliably engaging with a shield; and A third object of the present invention is to provide an electrical connector having a contact module assembly which securely fits in the connector.

An electrical connector of the present invention has a dielectric housing forming a pair of abutment walls extending from a bottom end thereof, a contact module assembly received in the housing, a pair of grounding elements and a shield attached to the housing and establishing solid grounding contact with the grounding elements.

A pair of integrally formed locking recesses is provided adjacent to the abutment walls of the housing for receiving the grounding elements. Each grounding element includes a flat joining part with a grounding finger and a board lock extending from one lateral edge of the joining part, and a plurality of interfering bumps on an opposite edge of the joining part. Each grounding finger extends approximately horizontally for fitting along an abutment wall of the housing. The plurality of interfering bumps helps to fix the grounding elements in the locking recesses. The shield includes a pair of top and bottom extending arms which attach the shield to the housing and the grounding elements.

In assembly, when the grounding elements are received in the locking recesses of the housing, the grounding fingers thereof fit along the abutment walls of the housing and the board locks thereof extend downwardly from the bottom of the housing for mounting the connector to a PCB. The shield is then mated to the housing and the top and bottom extending arms are bent to engage with the top, bottom and rear sides of the housing. Furthermore, the bottom extending arms concurrently fix the grounding fingers to the abutment walls of the housing while establishing electrical grounding contact between the shield and the grounding elements.

The housing also defines a receiving recess in a rear thereof which forms a plurality of apertures and spaced-apart channels for fitting with a plurality of embossments and projections on a contact module assembly to secure the contact module assembly in the housing.

Other objects, advantages and novel features of the invention will become more apparent from the following detailed description of the present embodiment when taken in conjunction with the accompanying drawings.

DETAILED DESCRIPTION OF INVENTION

Figure 1:
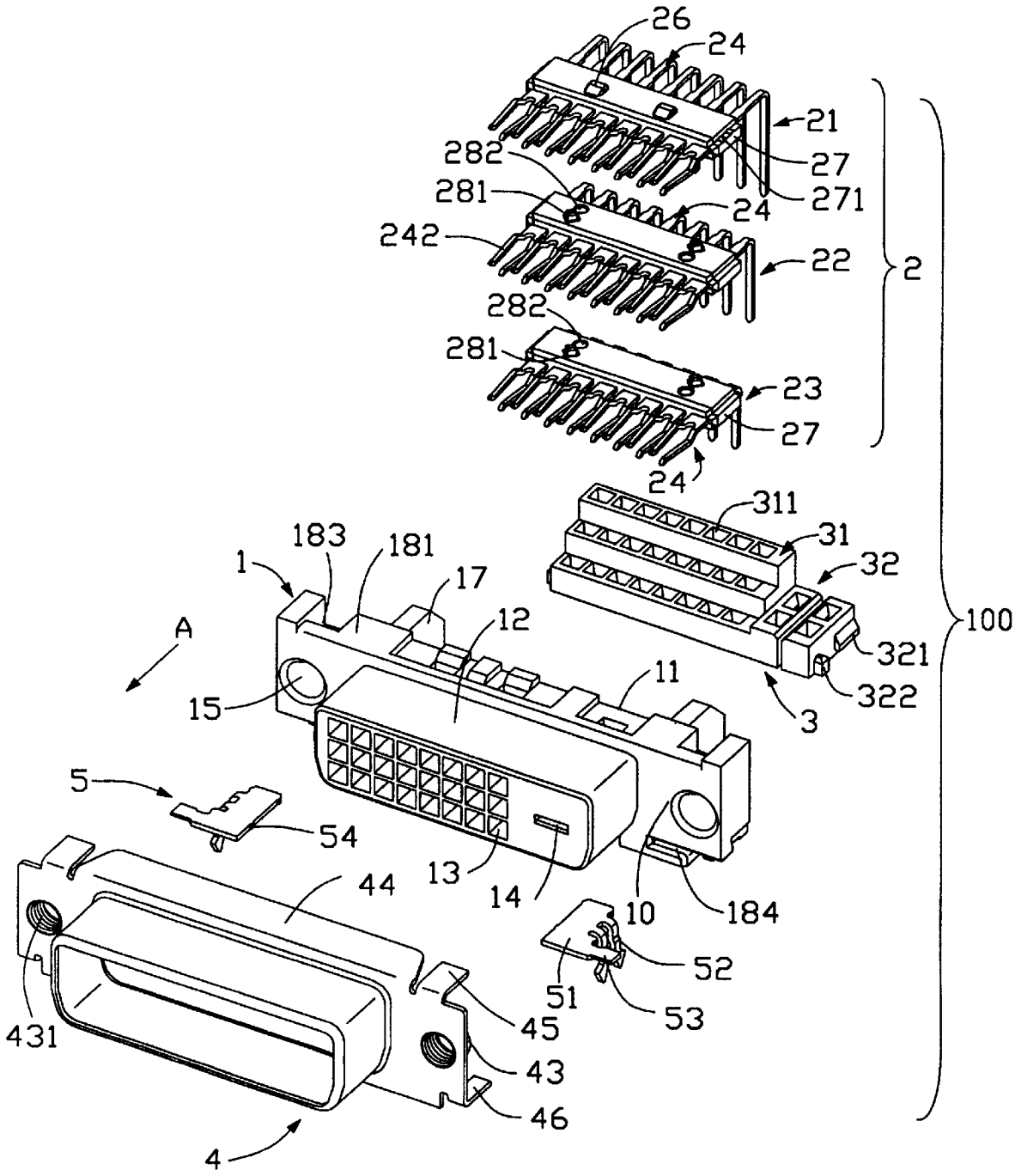
FIG. 1 is an exploded view of an electrical connector of the present invention.

Referring to FIG. 1, an electrical connector 100 provided for mating with a complementary connector (not shown) includes an insulative housing 1, a contact module assembly 2 to be received in the housing 1, a spacer 3 for equidistantly spacing soldering tails of terminals of the connector 100 and securing the contact module assembly 2 in the housing 1, a conductive shield 4 to be attached to a front end of the housing 1 and a pair of grounding elements 5 for mounting the connector 100 on a PCB (not shown) and connecting the shield 4 to ground.

Figure 2:
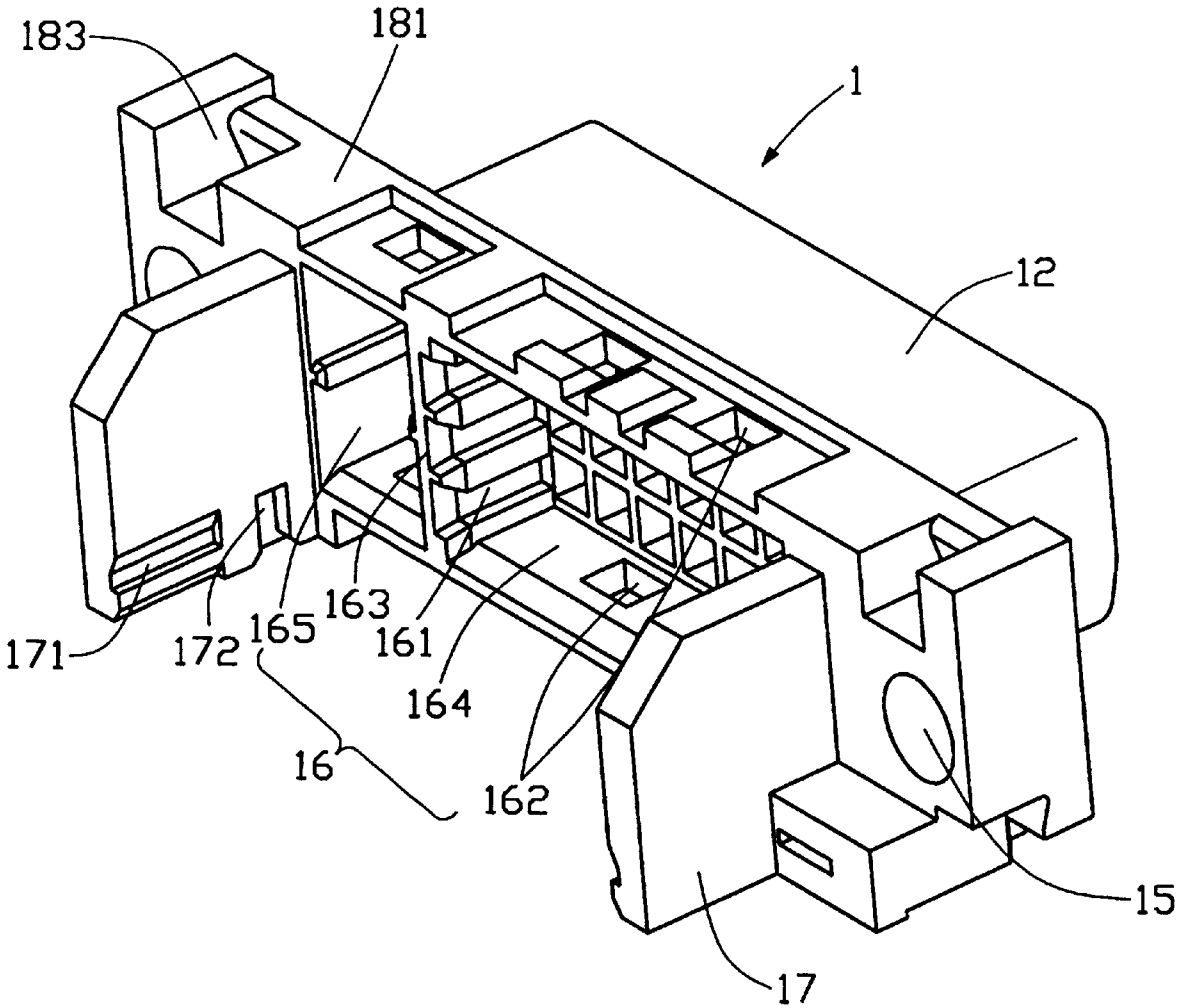
FIG. 2 is a rear perspective view of a housing of the electrical connector of FIG. 1.

The housing 1 has a front mating surface 10 from which a mating portion 12 forwardly projects and a connecting surface 11 at a rear side thereof opposite the mating surface 10. The mating portion 12 defines a plurality of receiving passages 13 oriented in direction "A". The mating portion 12 further defines a grounding slot 14 proximate to a lateral end thereof through which a grounding element of a complementary connector (not shown) inserts. A pair of securing holes 15 is defined in opposite ends of the housing 1. Further referring to FIG. 2, a pair of opposite holding walls 17 depends perpendicularly rearward from the connecting surface 11 and a rearward facing receiving opening 16 is defined in the connecting surface 11 of the housing 1 between the holding walls 17. The receiving opening 16 is divided by a divider 163 to form a recess 165 for receiving a corresponding grounding portion of the complementary connector and a receiving recess 164. The receiving recess 164 is adapted to receive the contact module assembly 2 and has integrally constructed spaced-apart channels 161 defined in opposite interior sides thereof (only one side being shown in FIG. 2). Top and bottom walls (not labeled) for defining the receiving recess 164 respectively forming a plurality of apertures 162 therethrough for securing the contact module assembly 2 in the receiving recess 164. The distance between the holding walls 17 equals the lateral dimension of the spacer 3. The holding walls 17 each further define a notch 171 and a cutout 172 adjacent to a bottom edge of an interior side thereof for securing the spacer 3 therebetween. A pair of fixing channels 183 is defined at opposite ends of a top surface 181 of the housing 1.

Figure 3:
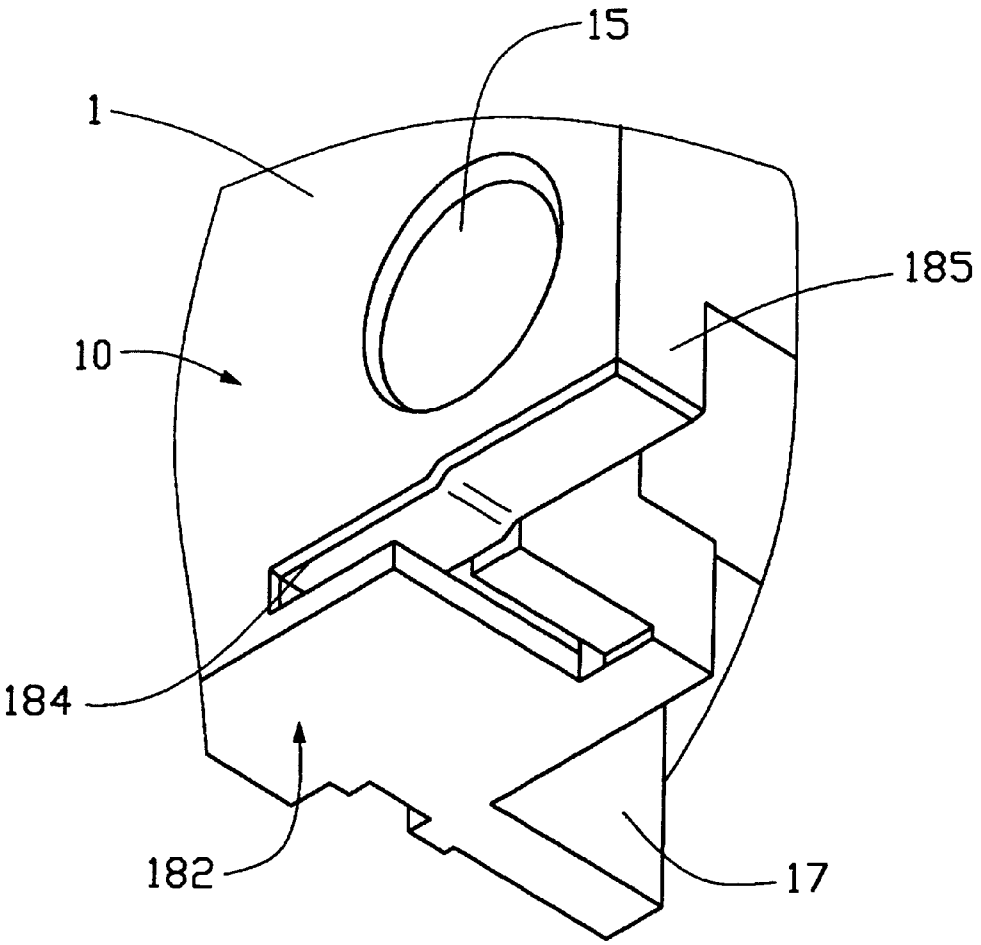
FIG. 3 is a partially enlarged view of a bottom, front portion of the housing of FIG. 2 showing a locking recess.

Referring to FIGS. 1 and 3, a pair of locking recesses 184 (only one shown) proximate to a bottom surface 182 communicates with the mating surface 10 of the housing 1 and rearwardly extends from the mating surface 10 for insertion of the grounding elements 5. A pair of stepped abutment walls 185 (only one shown) formed on two lateral sides of the mating surface 10 above locking recesses 184 for abutting the grounding elements 5, respectively.

Figure 4:
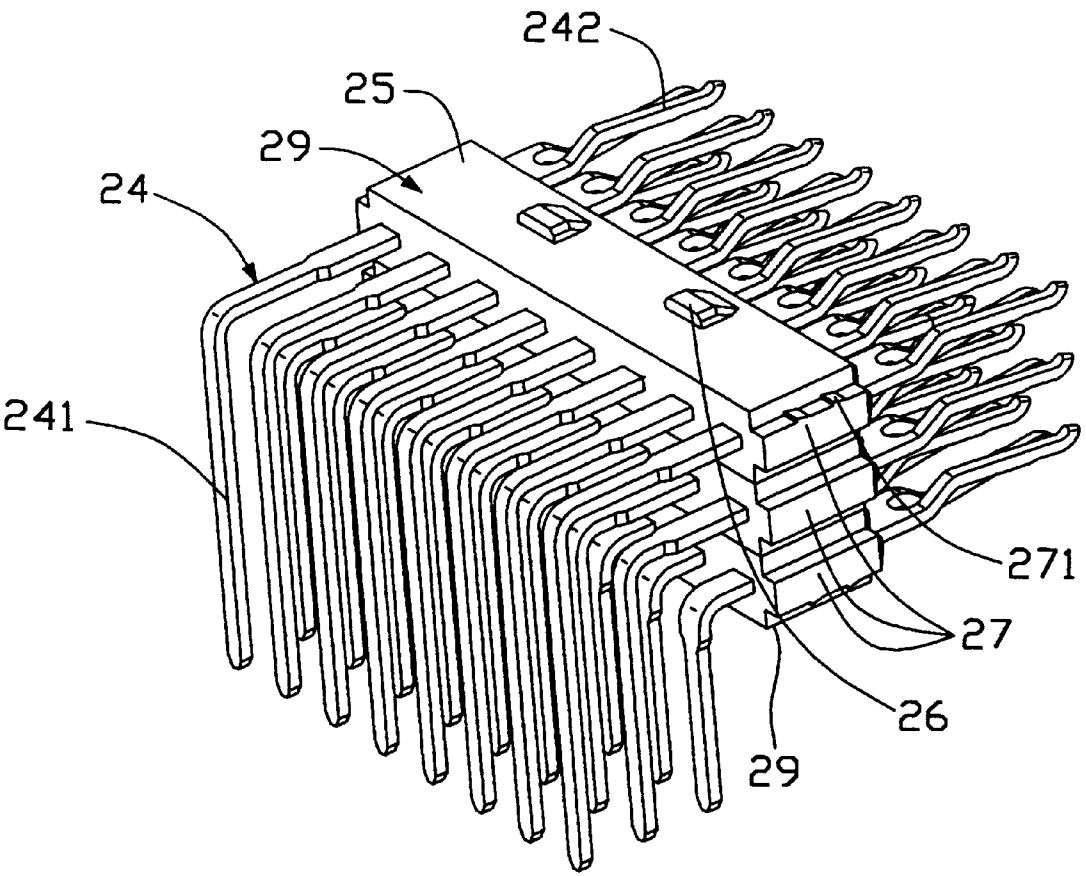
FIG. 4 is a perspective view of a contact module assembly comprising three contact modules stacked together.
Figure 5:
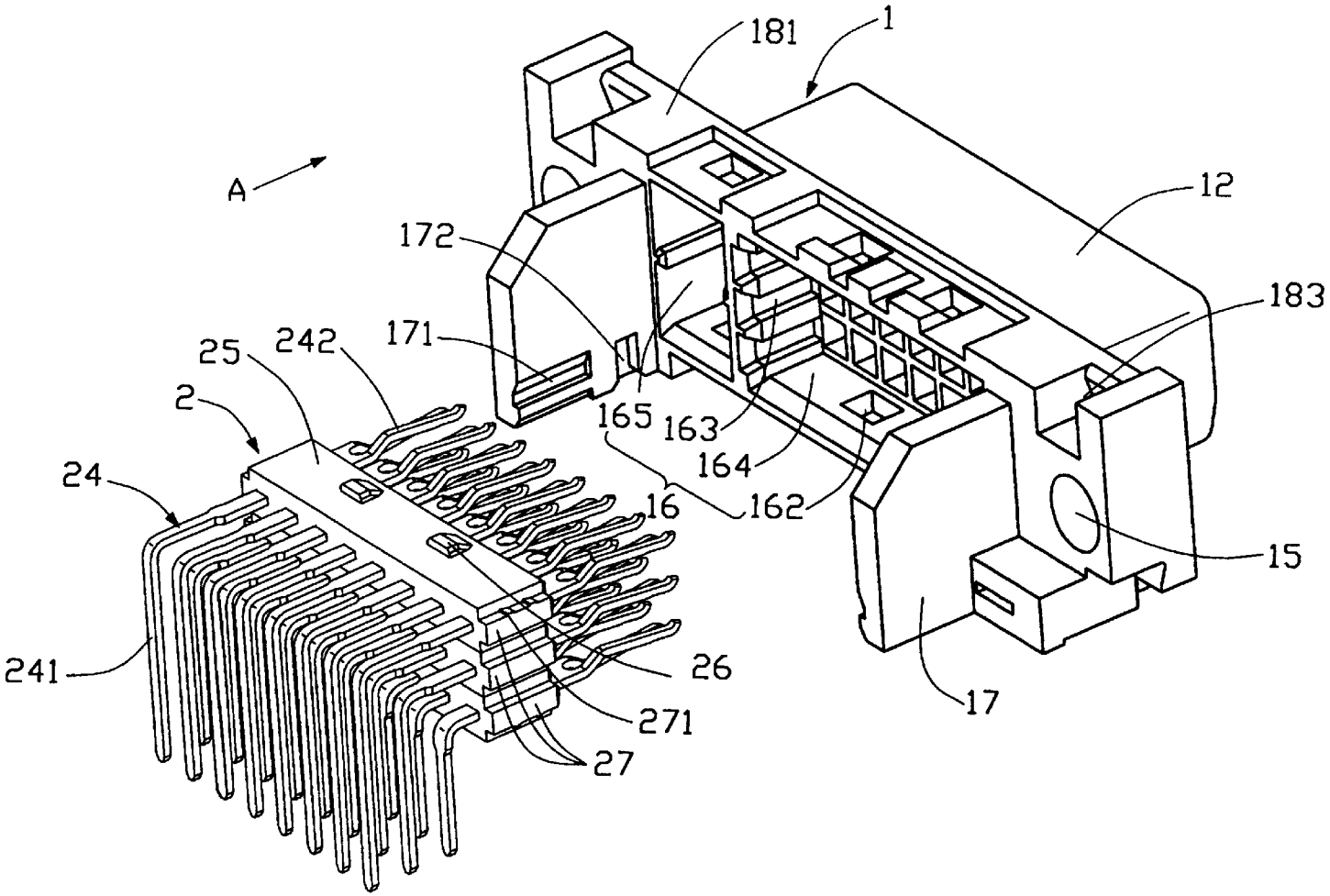
FIG. 5 is a perspective view of the contact module assembly of FIG. 4 about to be received into the housing of FIG. 2.

As shown in FIGS. 1, 4 and 5, the contact module assembly 2 includes three stacked and fastened together contact modules 21, 22 and 23, each having a plurality of conductive terminals 24 arranged in a line and insert molded within an insulative body 25. The terminals 24 each have an engaging end 242 and an opposite soldering tail 241 perpendicularly and downwardly bent from the engaging end 242 The similar contact modules 21 and 23 each have a pair of embossed sections 26 on engaging faces 29 of their respective insulative bodies 25 to interlock with the apertures 162 in the housing 1. A pair of projections 27 outwardly protrudes from opposite lateral sides of each of the insulative bodies 25, each projection 27 forming a plurality of interfering barbs 271 thereon for further interferentially fitting in the channels 161 of the housing 1. The barbs 271 are located on top faces of the projections 27 of the contact module 21 and on bottom faces of the projections 27 of the contact module 23. Two mounting devices each including a peg 281 and an aperture 282 are formed on surfaces opposite the engaging surfaces 29 of the contact modules 21 and 23 to fit with corresponding receiving apertures 282 and pegs 281 on opposing surfaces of the contact module 22. The position of the peg 281 and aperture 282 of a mounting device on a surface of a module is reversed to that of the other mounting device on the corresponding surface of the module. When the contact modules 21, 22 and 23 are fastened together to form the contact module assembly 2, the tips of the soldering tails 241 of the terminals 24 are coplanar.

Figure 6:
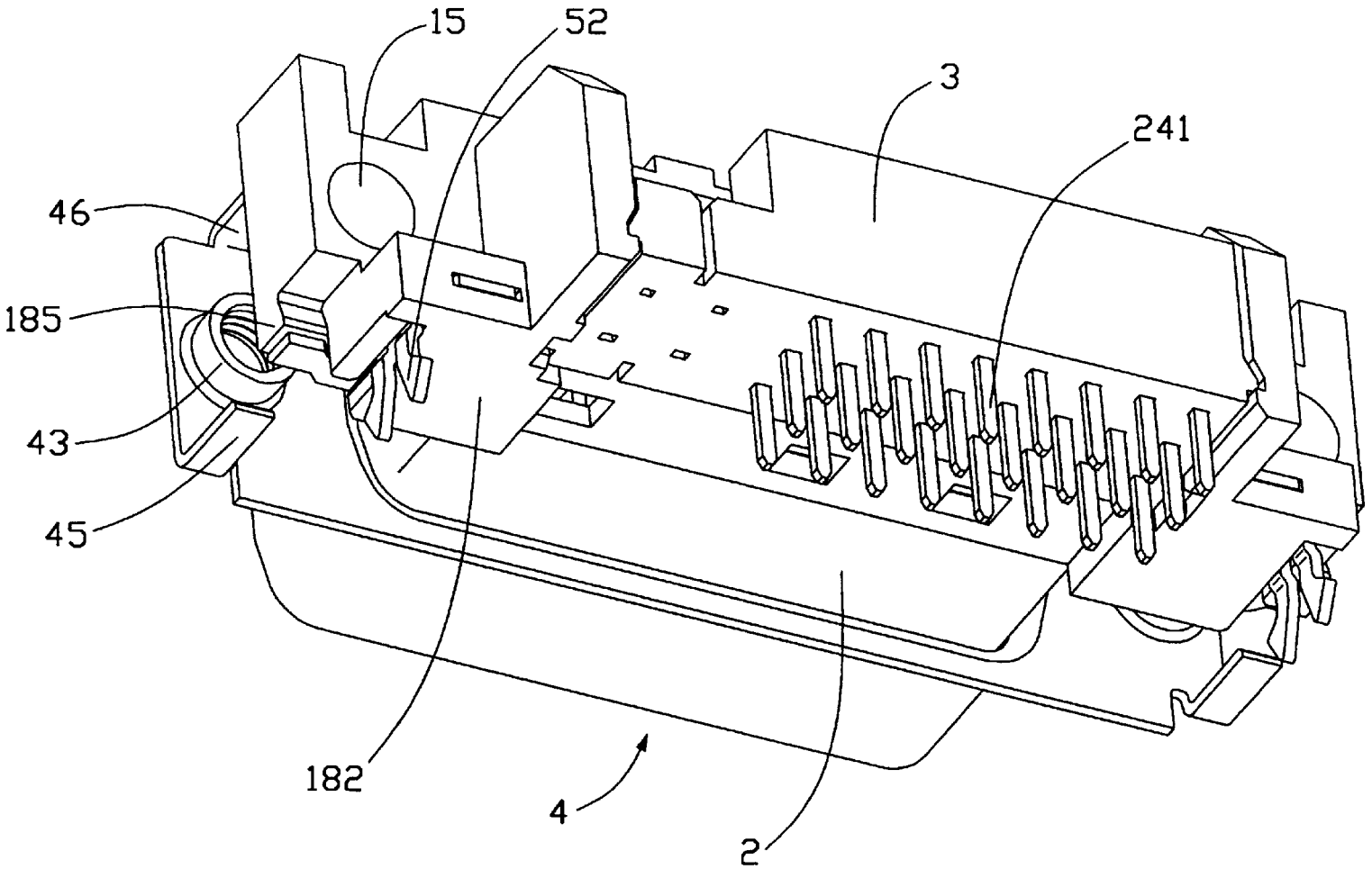
FIGS. 6 and 7 show sequential views from a bottom rear aspect of mounting a shield to the connector.
Figure 7:
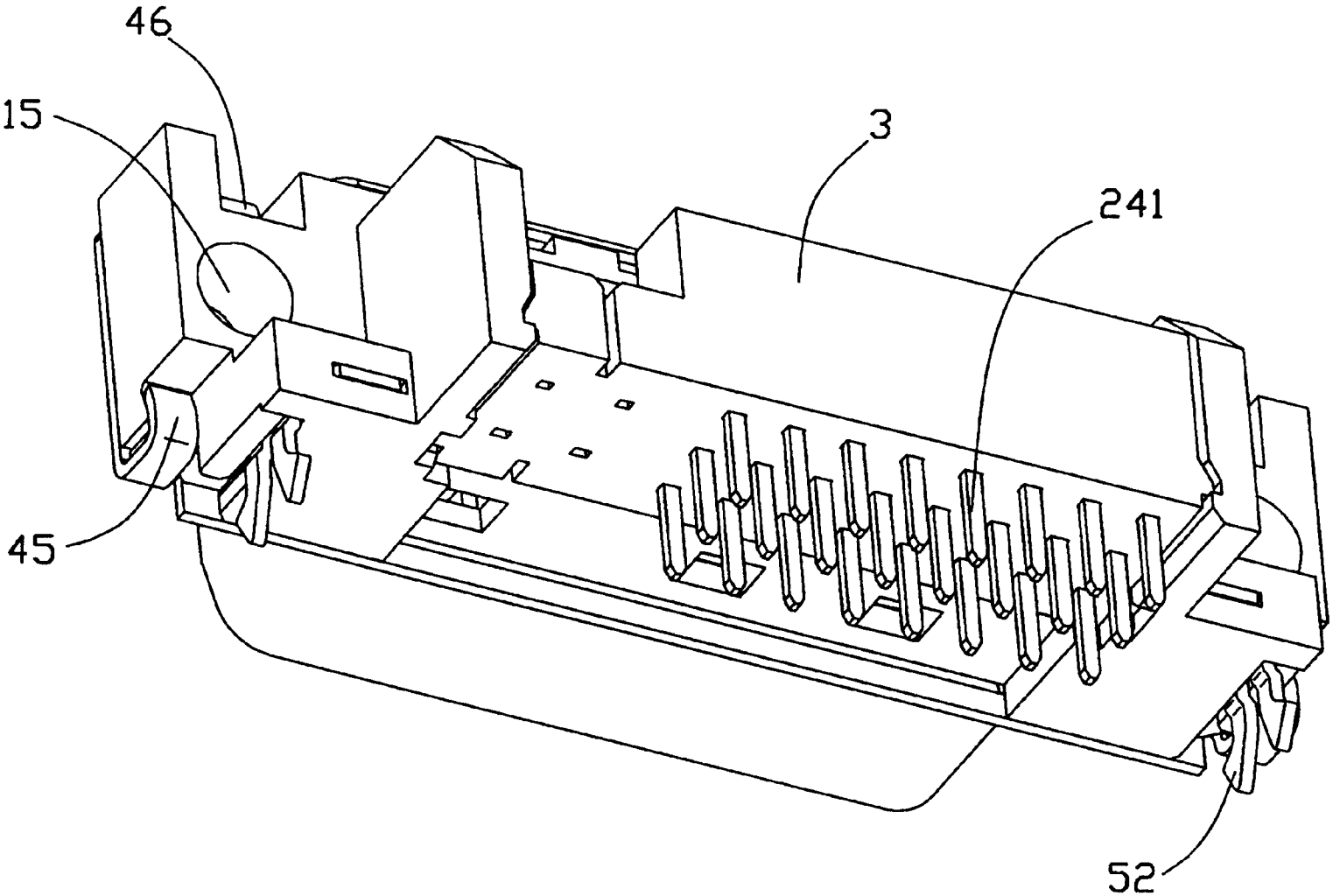

As shown in FIGS. 1, 6 and 7, the integrally constructed insulative spacer 3 includes a first portion 31 and a second portion 32 adjacent to the first portion 31. The first portion 31 is configured in steps of a selected height to couple with the terminals of the contact modules 21, 22 and 23. A plurality of positioning holes 311 in the first portion 31 receives soldering tails 241 of the terminals 24, thereby spacing two neighboring soldering tails 241 with a predetermined distance. A pair of retaining ribs 321 (only one shown) and latch caps 322 (only one shown) formed on opposite lateral sides (only one shown) of the spacer 3 respectively fit with the notches 171 and the cutouts 172 of the holding walls 17 to fix the spacer 3 in the housing 1.

Securing posts 43 are integrally stamped and formed with the shield 4 and have inner screw threads 431 to lock with securing screws attached to lateral sides of the complementary connector when the connector 100 is mated with the complementary connector. An integrally formed shroud 44 rearwardly extends from the middle of a top edge of the shield 4. A pair of top extending arms 45 is formed separately to either side of the shroud 44 and a pair of bottom extending arms 46 bends rearwardly from a bottom edge of the shield 4.

A pair of grounding elements 5 (see FIG. 1) is integrally stamped and formed from a metal plate. Each grounding element 5 comprises a horizontal joining part 51 adjoining a horizontal grounding finger 53 and a vertical board lock 52. The board lock 52 has a pair of latch legs which depends downwardly from an edge of the joining part 51. The grounding fingers 53 horizontally extend from a lateral edge of the joining part 51 for making electrical contact with the bottom extending arms 46 of the shield 4 to keep the shield electrically grounded (detail description hereinafter). A plurality of interfering bumps 54 on an edge of each joining part 51 opposite the board locks interferentially engages with the locking recesses 184.

Referring to FIGS. 1 through 7, in assembling, when the pegs 281 and the receiving apertures 282 are appropriately interlocked, the contact modules 21, 22 and 23 constitute the contact module assembly 2. The contact module assembly 2 is then slidingly inserted into the receiving recess 164 in direction "A" (FIG. 1), the engaging ends 242 of the conductive terminals 24 being received in the receiving passages 13 in the mating portion 12 of the housing 1. The projections 27 engage with the spaced apart channels 161 of the housing 1 and the embossed sections 26 lock with the apertures 162 in the receiving opening 16. The spacer 3 is inserted from the bottom upward and the soldering tails 241 are received into the positioning holes 311. The retaining ribs 321 and the latch caps 322 on the spacer 3 engage with the notches 171 and the cutouts 172 in the holding walls 17 so as to retain the spacer 3 between the holding walls 17. Then, the grounding elements 5 are inserted into the locking recesses 184 from the front to the rear so that the board locks 52 protrude from the bottom of the housing 1 for fixing into the PCB and the grounding fingers 53 lie against a bottom face of the abutment walls 185 of the housing 1. The shield 4 is then engage with the mating surface 10 of the housing 1, the securing posts 43 inserting into the securing holes 15. The bottom extending arms 46 of the shield 4 are bent in compliance with a contour of an end portion of each of the abutment walls 185, thereby tightly pressing the horizontal grounding fingers 53 of the grounding members 5 onto the abutment walls 185, thus, the shield 4 and the grounding members 5 are mechanically and electrically connected together. By the bending of the bottom extending arms 46 onto the abutment walls 185, the bottom edge of the shield 4 is secured to the housing 1. At the same time, the top extending arms 45 are bent into the corresponding fixing channels 183 to engage with the housing 1, thereby securing the top edge of the shield 4 to the housing 1.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing having a receiving recess in a rear end thereof, and a pair of locking recesses proximal to a bottom end thereof;

a contact module assembly slidingly engaged in the receiving recess and including at least two stacked and interlocked contact modules, each contact module receiving a plurality of conductive terminals;

a pair of grounding elements each including a joining part for being secured in the respective locking recess of the housing, a board lock depending from a lateral edge of the joining part, and a grounding finger extending from the lateral edge of the joining part; and a conductive shield covering a front end of the housing and having a pair of bottom extending arms positioned to contactingly secure the grounding fingers to the housing;

wherein the housing has a pair of laterally extending abutment walls, the grounding fingers fitting against the abutment walls for contacting with and being secured by the bottom extending arms of the shield;

wherein said board lock of each grounding element downwardly bends from a lateral edge of said joining part to fix into a mounting hole in a printed circuit board, and said grounding fingers extend approximately horizontally;

wherein said grounding elements each have a plurality of interfering bumps projecting from an edge of the joining part different from the edge from which the board locks depend for interferingly engaging with the locking recesses of the housing;

wherein said grounding elements are each stamped and formed from a metal plate;

wherein the receiving recess defines a plurality of uniformly spaced channels in opposite interior faces thereof and a plurality of apertures in top and bottom walls thereof for fixing the contact assembly module;

wherein said contact modules are stacked and interlocked with a plurality of pegs and receiving apertures to form the contact module assembly;

wherein the contact module assembly has lateral projections defining interfering barbs for reliably engaging the contact module assembly with the receiving recess, the barbs being located on a top face of each projection on an upper contact module and on a bottom face of each projection on a lower contact module.

* * * * *